US005406650A

United States Patent [19]

Einbinder

[11] Patent Number: 5,406,650

[45] Date of Patent: Apr. 18, 1995

[54] URINE RECEIVER

[76] Inventor: Eli Einbinder, 121 E. 60th St., New York, N.Y. 10022

[21] Appl. No.: 250,389

[22] Filed: May 27, 1994

[51] Int. Cl.[6] ..... A47K 11/12; A61G 9/00

[52] U.S. Cl. ..... 4/144.2; 4/144.3; 383/16; 383/80; 383/100; 604/329; 604/349

[58] Field of Search ..... 4/144.1, 144.2, 144.3; 383/16, 80, 100; 604/329, 331, 335, 349, 350, 351, 352, 353

[56] References Cited

U.S. PATENT DOCUMENTS

| | | | |
|---|---|---|---|
| 137,214 | 3/1873 | Knight et al. | 4/144.3 |
| 3,335,714 | 8/1967 | Giesy | 4/144.3 X |
| 3,339,551 | 9/1967 | Stoutenburgh | 604/349 |
| 3,559,651 | 2/1971 | Moss | 604/349 |
| 3,835,857 | 9/1974 | Rogers, III et al. | 604/349 |
| 4,068,696 | 1/1978 | Winchell | 383/80 X |
| 4,387,726 | 6/1983 | Denard | 128/760 |
| 4,713,066 | 12/1987 | Komis | 604/353 |
| 4,815,151 | 3/1989 | Ball | 4/144.3 |
| 4,911,562 | 3/1990 | Mazzeschi | 383/16 |
| 4,994,051 | 2/1991 | Walsh | 604/349 |
| 5,007,116 | 4/1991 | Yamamoto | 4/144.2 |
| 5,139,493 | 8/1992 | Hogan | 604/349 |
| 5,147,341 | 9/1992 | Starke et al. | 604/349 |
| 5,195,997 | 3/1993 | Carns | 604/347 |
| 5,267,989 | 12/1993 | Moyet-Ortiz | 604/349 |
| 5,309,578 | 5/1994 | Temple, Sr. | 4/144.3 |

OTHER PUBLICATIONS

"Campmor Catalog Extract", Spring 1994, 1 pg.

*Primary Examiner*—Robert M. Fetsuga
*Attorney, Agent, or Firm*—Jones, Tullar & Cooper

[57] ABSTRACT

A urine receiver for sanitary use away from rest-room facilities; the receiver may also be used by the bedridden. The receiver includes an inlet, an air outlet vent, an expandable bag member, a sealing plastic cap and may have a disinfectant and deodorant for rendering potentially harmful human waste safe for public disposal. The urine receiver also includes a top handle and a bottom handle to facilitate use, and may be used with a vaginal adaptor.

16 Claims, 2 Drawing Sheets

FIG. 2
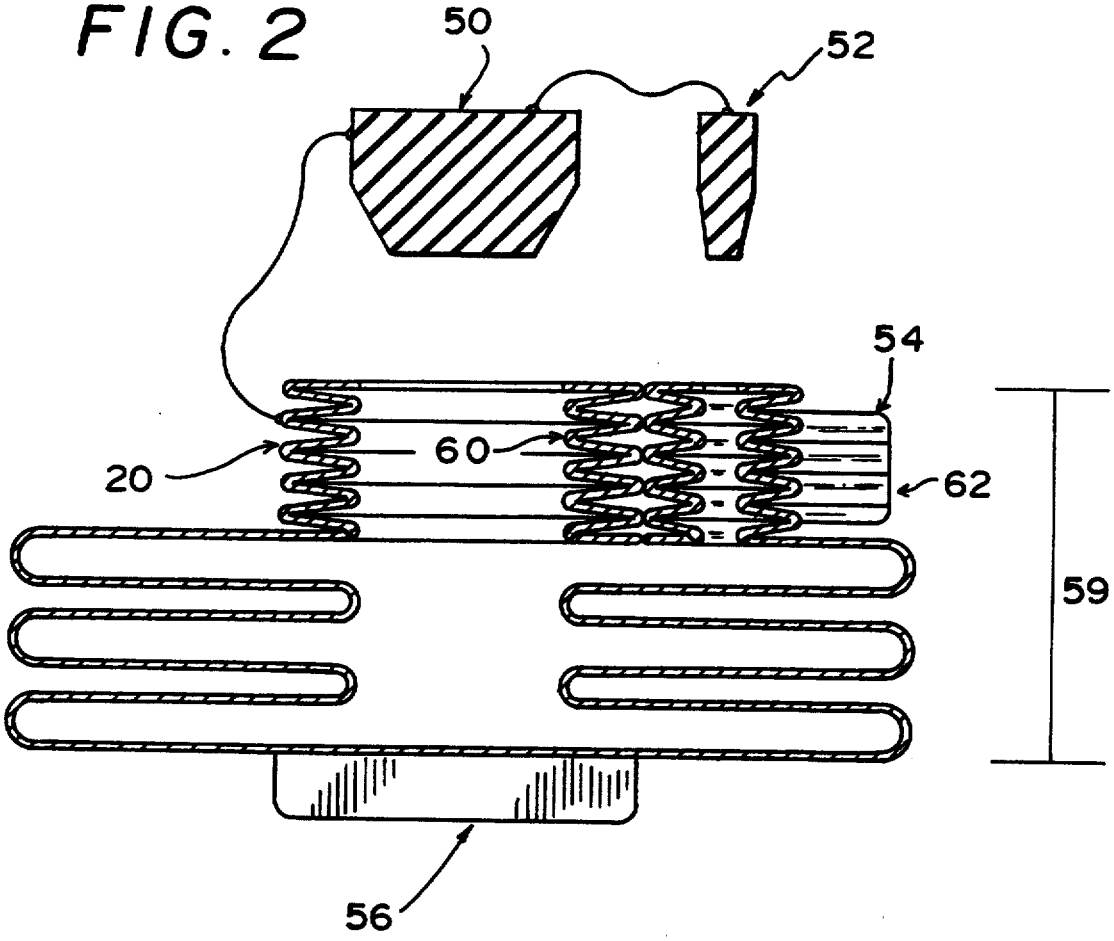
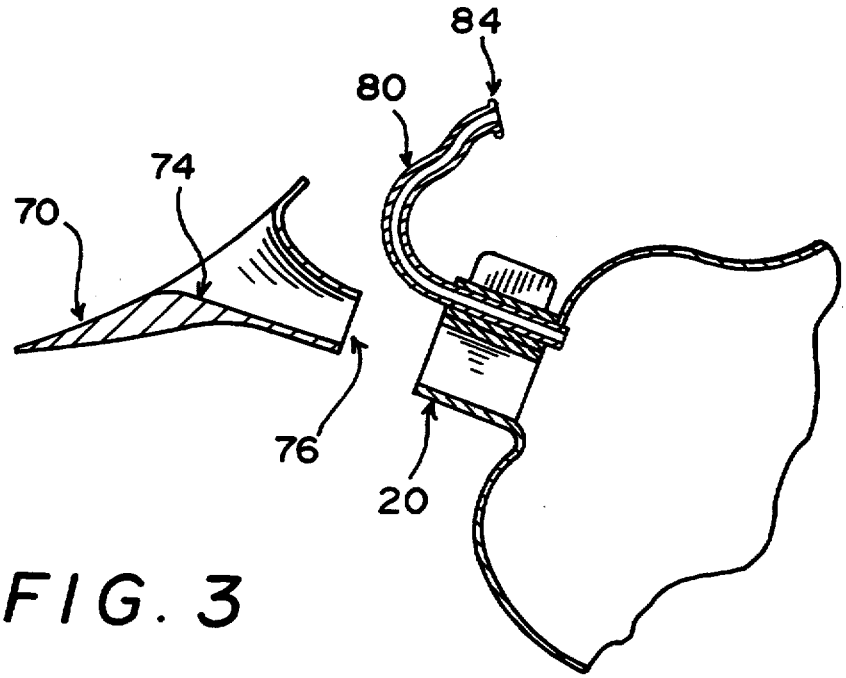
FIG. 3

URINE RECEIVER

BACKGROUND OF THE INVENTION

The present invention pertains, in general, to sanitary collection and disposal of human waste products, such as urine, and a receptacle which can be used by the bedridden or in situations where sanitation facilities are not readily available.

For those who enjoy the outdoors, one problem which must be dealt with is finding a sanitation facility for urinating. There have been a number of devices intended to meet this need but those devices have been messy and difficult to use, difficult to carry, or difficult to store once used. With the increasing urgency of our need for public sanitation due to the HIV epidemic and similar diseases, it has become more important to provide such devices and to dispose of waste in a sanitary manner. A related problem arises with travelers and others who have emergency needs, but who cannot locate suitable facilities.

Analogously, sanitary collection of waste products for the bedridden has been difficult or painful. A bedridden patient who does not desire the discomfort of a catheter has been forced to contend with a potentially messy bedpan. The present invention addresses this need as well, thereby easing the burdens on a hospital's staff.

SUMMARY OF THE INVENTION

The present invention is directed to a urine receiver and container which includes an expandable bag member, an air outlet vent, a specially shaped inlet section to facilitate use and a cap or plug which can be used to seal the urine receiver after use. The urine receiver also includes an antibacterial, antifungal or disinfecting agent which effectively sterilizes the urine once received into the bag so that the device functions as a storage container. The urine receiver is a unitary structure which can be stored in a collapsed manner and then expanded for use; one need not assemble the receiver from a plurality of parts. This avoids messy leaks and makes the receiver ready to use in a hurry.

In use, the inlet section can be tightly sealed to a user's penis or vagina and a separate air outlet vent tube allows displaced air to leave the interior of the bag. In one embodiment, the inlet portion is collapsible for further compactness and smaller storage. The urine receiver may be fabricated from a flexible, non-porous material and is light in weight and easy to carry.

The receiver may include a number of special adaptations for use by women. The vent tube may be extendable to provide unobstructed passage for displaced air. The receiver may also be used with a urinary guide which is fitted over the vagina for guiding urine into the receiver inlet.

BRIEF DESCRIPTION OF THE DRAWINGS

The foregoing and additional objects, features and advantages of the invention will become apparent to those of skill in the art from the following detailed description of a preferred embodiment, taken with the accompanying drawings, in which:

FIG. 2 shows a preferred embodiment of the urine receiver in its collapsed condition for storage and conveyance.

FIG. 3 shows another preferred embodiment of the urine receiver with an extendible vent tube and a urinary guide which is placed over a user's vagina.

DETAILED DESCRIPTION

Figures 1, 1A:
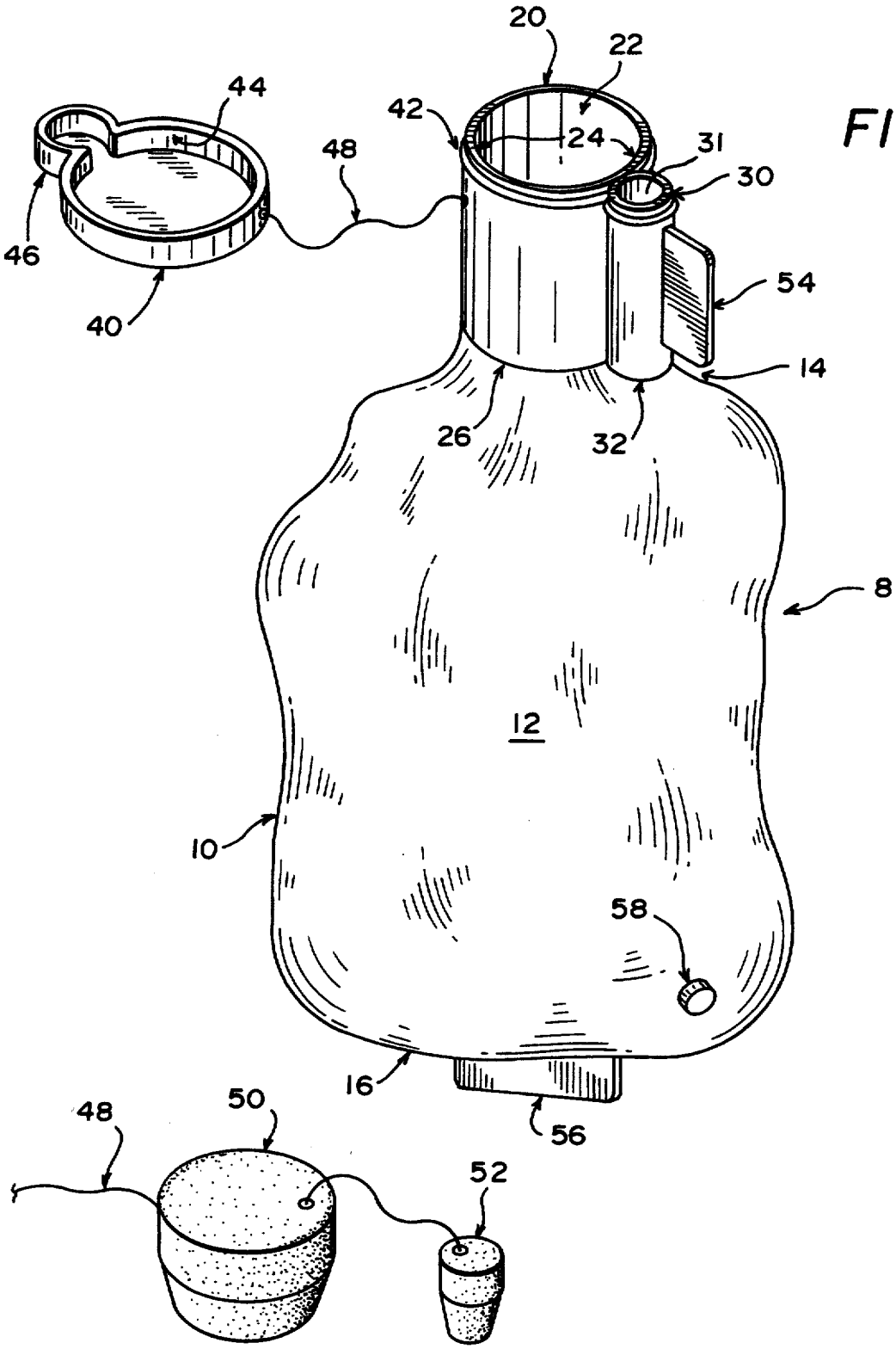
FIG. 1 shows a preferred embodiment of the urine receiver in its expanded and ready-to-use condition.
FIG. 1*a* shows an alternative embodiment for sealing the urine receiver, using plugs.

Turning now to a more detailed description of the invention, there is illustrated in FIG. 1, a preferred embodiment of a urine receiver 8 having a bag portion 10 shown in its fully extended condition. In the preferred embodiment, the bag 10 is made of one or more layers of latex material. In another embodiment, this bag may be made of plastic or any other flexible, resilient, non-porous material. The bag has an interior 12, a top end 14 and a distal end 16.

A top part of the urine receiver 8 comprises an inlet 20. The inlet is generally tubular, has an interior portion 22, a top opening 24 and a bottom opening (not shown). The inlet opening 24 is of a diameter which will accommodate insertion of an adult penis. The inlet tube has a length approximately equal to the inlet opening diameter. The inlet may be fabricated from any material which provides a non-porous, flexible, compressible, elastic, sealing structure. The inlet is in fluid communication with the bag interior 12 at junction 26.

Adjacent to the inlet portion is an air outlet vent 30; the air outlet vent has an opening 31, is affixed to the inlet and is preferably shaped as a tube of much smaller diameter than the inlet. The vent tube 30 may be affixed to the inlet tube 20 by any suitable means such as gluing or bonding, or the two tube sections 20, 30 may be molded as one piece. The air outlet vent forms a conduit which is in fluid communication with the bag interior 12 at junction 32. The inlet and vent may be affixed to the bag by any suitable means such as welding, gluing, ultrasonically bonding or thermally bonding to the bag, or alternatively, the inlet, vent and bag may be molded as a unitary structure.

The urine receiver also includes a sealing cap 40 which can snap onto a retaining ridge 42 about the circumference of the inlet 20. The sealing cap is non-porous, resilient, and has a flange 44 which may be snap-fit onto the inlet and held on by the cooperative retention of the inlet retaining ridge 42. The sealing cap for the inlet tube and vent tube is shown as one piece having a separate cap portion 46 covering the vent; in an alternative embodiment, the vent may be sealed by a smaller separate cap. If a separate smaller cap is used to cover the vent 30, the inlet sealing cap and smaller sealing cap may alternatively be attached to both the inlet and the vent by a threaded connection or by a bayonet-like connection.

Sealing cap 40 may also be attached to the inlet 20 by a keeper string 48.

The sealing of the urine receiver, in another embodiment, may be accomplished with plug portions, 50 and 52, which are made from a compressible, resilient material having significant static friction, such as rubber or the like. Plugs 50 and 52 are stopper-shaped, meaning that they are generally frusto-conical, and may be tapered for easy insertion. Plugs 50 and 52 are press-fit into the interior of the inlet and the vent and held in place by friction, thereby plugging and sealing the inlet and the vent. The sealing plugs 50 and 52 at least partially fill the inlet and the vent. These plugs may be held in place by a clamp, strap or elastic band which forces the plugs to stay in the inlet and vent openings.

To facilitate use, the urine receiver has a top handle 54 and a bottom handle 56. The top handle 54 is affixed to either the inlet 20 or the vent 30. In the embodiment or FIG. 1, top handle 54 is shown attached to vent tube 30. The bottom handle 56 is attached to the distal end of the bag 16. The handles, 54 and 56, are preferably flat tabs of flexible material which may be readily grasped and used to control the position of the urine receiver.

In a preferred embodiment of the invention, the interior of the urine receiver receives a tablet 58. This tablet can be an antibacterial, antifungal, antiviral, disinfectant or deodorant agent which is used to render infectious urine harmless and less malodorous, for disposal in a public facility. The urine receiver may also include a separate deodorant to neutralize odor. In an alternative embodiment, the disinfectant is in the form of a powder, gel or stick of material. The disinfectant may be adhered to the receiver bag wall or to the interior of a sealing cap. A deodorant may be combined with the disinfectant or placed separately in the bag. Extra disinfectant and deodorant may be provided with the urine receiver, thus permitting re-use of the receiver.

The receiver is simple to use. For the male user, the penis is inserted into the inlet opening and is preferably made to be in intimate contact with the inlet. This allows a tight seal and avoids leaks and spills during use. As the bag 10 fills, displaced air is expelled through air outlet vent 30. The user holds the bag by lower handle 56 and upper handle 54. The upper handle may be positioned to allow the user to control the orientation of the vent 30, thereby avoiding spillage through the vent during use.

Once finished, the user covers the inlet and air outlet with plastic cap 40. In an alternative embodiment, the user seals the inlet 20 and vent 30 with sealing plugs 50 and 52.

Once the urine receiver has been sealed, the user may shake it to ensure that the disinfectant and deodorant has mixed with and decontaminated the urine. The receiver may then be carried to a public facility for disposal of the contents. If there is no public facility in which to dispose of the urine by pouring out the contents, the sealed urine receiver may be disposed of, as a package, in a garbage container.

Turning now to FIG. 2, it is shown that the bag can be compacted to a significantly smaller overall height 59 for conveyance before use. In one embodiment, the inlet 20 is made of collapsible material and has an accordion-like section 60. For this embodiment, the small handle at the top 54 also has accordion-like sections 62 thereby allowing the inlet section 20 to be collapsed along with the vent 30 and the top handle 54.

In an alternative embodiment, the inlet 20 and vent 30 may be folded flat along the axes of the tubes, thereby forming a flat, compact package.

Before use, the compacted urine receiver of FIG. 2 is grasped about the inlet 20 and by the bottom handle 56 and then pulled open into the extended shape shown in FIG. 1. The user may also puff into inlet opening 24 to expand the bag.

In yet another preferred embodiment, the receiver may be specially adapted for use by women. Turning now to FIG. 3, such an embodiment is shown which includes a vaginal adaptor 70 which includes an interior portion 74 and a conduit 76 for conveyance of urine from the urethra into the urine receiver inlet 20. The conduit is insertable into the inlet section opening 24. The adaptor 70 is placed tightly against the vagina, thereby avoiding spills during use. One vaginal adaptor urinary guide which would serve this purpose is that shown in U.S. Patent 4,815,151, to Diane M. Ball, the disclosure of which is hereby incorporated herein by reference.

Another adaption which facilitates use by women is an extendable vent tube 80, which may be slidably fitted within vent tube 30. The extendable vent tube has a stored position, within the bag 10, and an extended position, as shown in FIG. 3. The extendable vent tube is withdrawn prior to use. The vent tube may have a flange 84 which serves to keep the tube in position during storage by preventing the slippage of the tube into the bag. The flange also serves to provide a graspable edge that the user can inch in withdrawing and extending the vent tube.

The foregoing describes the preferred embodiments of the present invention along with a number of possible alternatives. A person of ordinary skill in the art will recognize that modifications of the described embodiments may be made without departing from the true spirit and scope of the invention. The invention is therefore not restricted to the embodiments disclosed above, but is defined in the following claims.

I claim:

1. A urine receiver, comprising:

an inlet section having a first opening in communication with a second opening;

a vent section having a third opening in communication with a fourth opening, said vent section affixed to said inlet section;

a receiving bag made from flexible resilient material and having an interior, an inlet end and a distal end, wherein said receiving bag interior is in communication with said inlet section at said inlet section second opening, and wherein said receiving bag interior is also in communication with said vent section at said vent section fourth opening;

a first handle attached to said inlet section;

a second handle attached to the distal end of the flexible bag; and a plastic cap which is removably attachable to said inlet section and said vent section, whereby the urine receiver is sealed.

2. The urine receiver of claim 1, further including a disinfectant in said bag for rendering human waste suitable for public disposal.

3. The urine receiver of claim 1, wherein said receiving bag is fabricated from latex.

4. The urine receiver of claim 1, wherein said receiving bag is fabricated from a plastic.

5. The urine receiver of claim 1, wherein said inlet section comprises a collapsible cylinder and said vent section comprises a second collapsible cylinder.

6. The urine receiver of claim 1, wherein said plastic cap is affixed by a flexible, extensible member to said inlet section.

7. A urine receiver, comprising:

an inlet section having a first opening in communication with a second opening;

a vent section having a third opening in communication with a fourth opening, said vent section affixed to said inlet section;

a receiving bag made from flexible resilient material and having an interior, an inlet end and a distal end, wherein said receiving bag interior is in communication with said inlet section at said inlet section second opening, and wherein said receiving bag interior is also in communication with said vent section at said vent section fourth opening;

a first handle attached to said inlet section;

a second handle attached to the distal end of said flexible bag;

a plastic cap which is removably attachable to said inlet section and said vent section, whereby the urine receiver is sealed;

wherein said plastic cap is affixed by a flexible, extensible member to said inlet section; and disinfectant in said bag for rendering human waste suitable for public disposal.

8. The urine receiver of claim 7, wherein said receiving bag is fabricated from latex.

9. The urine receiver of claim 7, wherein said receiving bag is fabricated from a plastic.

10. The urine receiver of claim 7, wherein said inlet section comprises a collapsible cylinder and said vent section comprises a second collapsible cylinder.

11. A urine receiver, comprising:

an inlet section having a first opening in communication with a second opening;

a vent section having a third opening in communication with a fourth opening, said vent section affixed to said inlet section;

wherein said inlet section comprises a collapsible cylinder and said vent section comprises a second collapsible cylinder;

a receiving bag made from flexible resilient material and having an interior, an inlet end and a distal end, wherein said receiving bag interior is in communication with said inlet section at said inlet section second opening, and wherein said receiving bag interior is also in communication with said vent section at said vent section fourth opening;

a first handle attached to said inlet section;

a second handle attached to the distal end of the flexible bag;

a plastic cap which is removably attachable to said inlet section and said vent section, whereby the urine receiver is sealed;

wherein said plastic cap is affixed by a flexible, extensible member to said inlet section; and a disinfectant in said bag for rendering human waste suitable for public disposal;

12. The urine receiver of claim 11, wherein said receiving bag is fabricated from latex.

13. The urine receiver of claim 11, wherein said inlet section, said vent section and receiving bag are fabricated from a plastic in a unitary molded structure.

14. The urine receiver of claim 11, wherein said vent section includes an extendable vent tube which is coaxial with said vent section and slidably fitted therein.

15. The urine receiver of claim 11, further including a vaginal adaptor which covers the vagina and conveys urine from the urethra to the interior of the bag section.

16. The urine receiver of claim 11, further including a deodorant in said bag for neutralizing odor.

* * * * *

UNITED STATES PATENT AND TRADEMARK OFFICE

CERTIFICATE OF CORRECTION

PATENT NO. : 5,406,650

DATED : April 18, 1995

INVENTOR(S) : Eli Einbinder, M.D.

It is certified that error appears in the above-indentified patent and that said Letters Patent is hereby corrected as shown below:

Column 5, claim 7, line 13. of the claim --a-- should be inserted before "disinfectant".

Signed and Sealed this

Twenty-ninth Day of August, 1995

Bruce Lehman

*Attest:*

BRUCE LEHMAN

*Attesting Officer*

*Commissioner of Patents and Trademarks*